US009336714B2

(12) United States Patent
Kim et al.

(10) Patent No.: US 9,336,714 B2
(45) Date of Patent: May 10, 2016

(54) THRESHOLD VOLTAGE COMPENSATING PIXEL CIRCUIT AND ORGANIC LIGHT EMITTING DISPLAY USING THE SAME

(71) Applicants: Yong-Jae Kim, Yongin (KR); Hae-Yeon Lee, Yongin (KR); Bo-Yong Chung, Yongin (KR); Jin-Gon Oh, Yongin (KR)

(72) Inventors: Yong-Jae Kim, Yongin (KR); Hae-Yeon Lee, Yongin (KR); Bo-Yong Chung, Yongin (KR); Jin-Gon Oh, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 316 days.

(21) Appl. No.: 13/765,709

(22) Filed: Feb. 13, 2013

(65) Prior Publication Data

US 2014/0139408 A1 May 22, 2014

(30) Foreign Application Priority Data

Nov. 22, 2012 (KR) ..... 10-2012-0133026

(51) Int. Cl.
*G09G 3/34* (2006.01)
*G09G 3/32* (2016.01)

(52) U.S. Cl.
CPC ..... *G09G 3/3233* (2013.01); *G09G 2300/0852* (2013.01); *G09G 2300/0861* (2013.01)

(58) Field of Classification Search
CPC .. G09G 3/3233; G09G 3/3208; G09G 3/3696
See application file for complete search history.

(56) References Cited

U.S. PATENT DOCUMENTS

2006/0044244 A1* 3/2006 Numao ..... 345/92
2009/0243976 A1* 10/2009 Choi ..... 345/76
2011/0292014 A1 12/2011 Hwang
2012/0038682 A1 2/2012 Kang et al.
2013/0321376 A1 12/2013 Kim et al.

FOREIGN PATENT DOCUMENTS

KR 10-2011-0131961 A 12/2011
KR 10-2012-0014714 A 2/2012
KR 10-2013-0135506 A 12/2013

* cited by examiner

*Primary Examiner* — Dwayne Bost
*Assistant Examiner* — Sepehr Azari
(74) *Attorney, Agent, or Firm* — Lee & Morse, P.C.

(57) ABSTRACT

A pixel includes an organic light emitting diode (OLED), a first transistor having a gate electrode coupled to a first node, a first electrode coupled to a first power supply, and a second electrode coupled to the OLED, a first capacitor for storing a data signal, and a second capacitor coupled between the first node and the second electrode of the first transistor to charge a voltage corresponding to the data signal and a threshold voltage of the first transistor, wherein, in a period where a voltage stored in the first capacitor is supplied to the first node, the second capacitor is electrically blocked from the first node.

20 Claims, 6 Drawing Sheets

THRESHOLD VOLTAGE COMPENSATING PIXEL CIRCUIT AND ORGANIC LIGHT EMITTING DISPLAY USING THE SAME

CROSS-REFERENCE TO RELATED APPLICATION

This application claims priority to and the benefit of Korean Patent Application No. 10-2012-0133026, filed on Nov. 22, 2012, in the Korean Intellectual Property Office, and entitled "Pixel and Organic Light Emitting Display Device," the entire contents of which are incorporated herein by reference.

BACKGROUND

1. Field

Embodiments relate to a pixel and an organic light emitting display using the same, and more particularly, to a pixel capable of improving display quality and an organic light emitting display using the same.

2. Description of the Related Art

Recently, various flat panel displays (FPD) capable of reducing weight and volume that are disadvantages of cathode ray tubes (CRT) have been developed. The FPDs include liquid crystal displays (LCD), field emission displays (FED), plasma display panels (PDP), and organic light emitting displays.

Among the FPDs, the organic light emitting displays display images using organic light emitting diodes (OLED) that generate light by re-combination of electrons and holes. The organic light emitting display has high response speed and is driven with low power consumption.

SUMMARY

Embodiments are directed to a pixel, including an organic light emitting diode (OLED), a first transistor having a gate electrode coupled to a first node, a first electrode coupled to a first power supply, and a second electrode coupled to the OLED, a first capacitor for storing a data signal, and a second capacitor coupled between the first node and the second electrode of the first transistor to charge a voltage corresponding to the data signal and a threshold voltage of the first transistor. In a period where a voltage stored in the first capacitor is supplied to the first node, the second capacitor is electrically blocked from the first node.

The pixel may further include a second transistor coupled between a data line and a first terminal of the first capacitor, the second transistor being turned on when a scan signal is supplied to a scan line, a third transistor coupled between the first terminal of the first capacitor and the first node, and a fourth transistor coupled between the first node and a first terminal of the second capacitor, the fourth transistor having a turn on period that does not overlap a turn on period of the third transistor.

A second terminal of the first capacitor may be coupled to a fixed voltage supply.

The second terminal of the first capacitor may be coupled to an initializing power supply having a smaller voltage value than the data signal.

The pixel may further include a fifth transistor coupled between the first terminal of the second capacitor and the data line, the fifth transistor being simultaneously turned on and off with the third transistor, a sixth transistor coupled between the first terminal of the second capacitor and the data line, the sixth transistor having a turn on period that does not overlap a turn on period of the fifth transistor, a seventh transistor coupled between a second terminal of the second capacitor and an initializing power supply, the seventh transistor being simultaneously turned on and off with the sixth transistor, and an eighth transistor coupled between the second electrode of the first transistor and the OLED, the eighth transistor being simultaneously turned on and off with the fourth transistor.

The sixth transistor may have a turn on period that partially overlaps the turn on period of the fourth transistor.

The sixth transistor may have a turn on period that does not overlap the turn on period of the fourth transistor.

The pixel may further include a ninth transistor coupled between the first node and the initializing power supply, the ninth transistor being simultaneously turned on and off with the sixth transistor.

The pixel may further include a tenth transistor and an eleventh transistor each coupled between the first power supply and the first transistor, the eleventh transistor being coupled in parallel with the tenth transistor. The tenth transistor may be simultaneously turned on and off with the fourth transistor, and the eleventh transistor may be simultaneously turned on and off with the third transistor.

Embodiments are also directed to an organic light emitting display, including a control driver for supplying a first control signal to a first control line in a first period of one frame and for supplying a second control signal to a second control line in a second period of the one frame, a scan driver for sequentially supplying scan signals to scan lines in a third period of the one frame and for supplying an emission control signal to an emission control line in at least a partial period of the first period and the second period, a data driver for supplying a voltage of a reference power supply to data lines in the at least partial period of the first period and the second period, and for supplying a data signal in the third period, and pixels at intersections of the scan lines and the data lines and including a first transistor, a first capacitor, and a second capacitor. Each of the pixels may store a voltage corresponding to the data signal in the first capacitor in the third period, and charge a voltage corresponding to the data signal and a threshold voltage of the first transistor in the second capacitor, electrically blocked from the first capacitor, using the voltage stored in the first capacitor in the second period.

The reference power supply may be a specific voltage in a range of voltages of the data signal.

Each of the pixels may include an organic light emitting diode (OLED), the first transistor having a gate electrode coupled to a first node, a first electrode coupled to a first power supply, and a second electrode coupled to the OLED, the second capacitor coupled between the first node and the second electrode of the first transistor, a second transistor coupled between a data line and a first terminal of the first capacitor, the second transistor being turned on when the scan signal is supplied, a third transistor coupled between the first terminal of the first capacitor and the first node, the third transistor being turned on when the second control signal is supplied, and a fourth transistor coupled between the first node and a first terminal of the second capacitor, the fourth transistor being turned off when the emission control signal is supplied and turned on otherwise.

A second terminal of the first capacitor may be coupled to an initializing power supply set to have a smaller voltage value than the data signal.

The organic light emitting display may further include a fifth transistor coupled between the first terminal of the second capacitor and the data line, the fifth transistor being turned on when the second control signal is supplied, a sixth transistor coupled between the first terminal of the second capacitor and the data line, the sixth transistor being turned on when the first control signal is supplied, a seventh transistor coupled between a second terminal of the second capacitor and an initializing power supply, the seventh transistor being turned on when the first control signal is supplied, and an eighth transistor coupled between the second electrode of the first transistor and the OLED, the eighth transistor being turned off when the emission control signal is supplied and turned on otherwise.

The initializing power supply may be set to have a smaller voltage value than the data signal.

The scan driver may supply the emission control signal after the first control signal is supplied in the first period.

The data driver may supply a voltage of an off power supply at which the first transistor is turned off in at least a partial period of the first period.

The scan driver may supply the emission control signal so that the emission control signal overlaps the first control signal and the second control signal in the first period and the second period.

The data driver may supply the voltage of the reference power supply to the data lines in the first period and the second period.

The organic light emitting display may further include a ninth transistor coupled between the first node and the initializing power supply, the ninth transistor being turned on when the first control signal is supplied.

The organic light emitting display may further include a tenth transistor coupled between the first power supply and the first transistor, the tenth transistor being turned off when the emission control signal is supplied and turned on otherwise, and an eleventh transistor coupled between the first power supply and the first transistor, in parallel with the tenth transistor, the eleventh transistor being turned on when the second control signal is supplied.

BRIEF DESCRIPTION OF THE DRAWINGS

Features will become apparent to those of skill in the art by describing in detail example embodiments with reference to the attached drawings in which.

DETAILED DESCRIPTION

Figure 1:
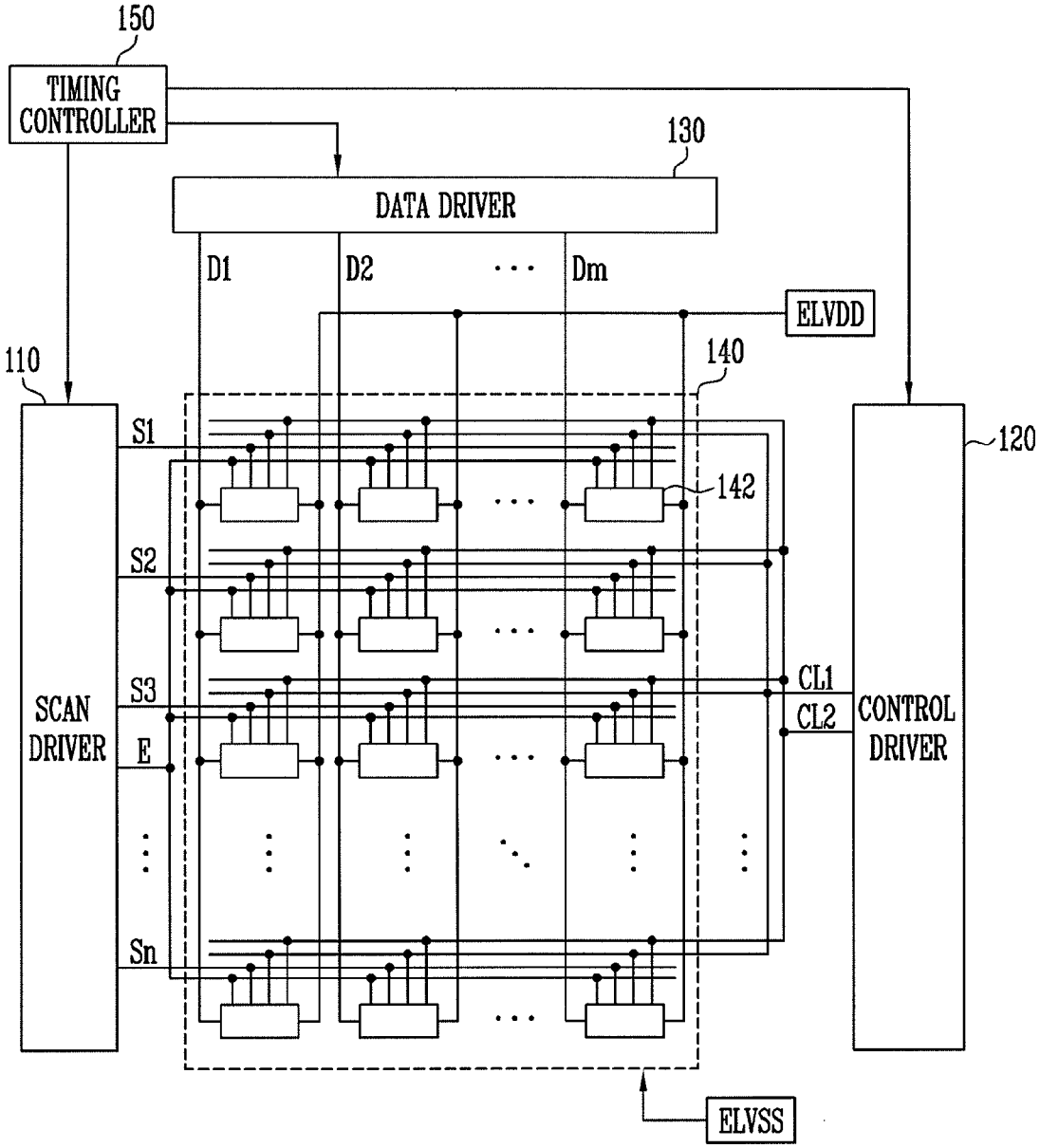
FIG. 1 is a view illustrating an organic light emitting display according to an embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "on" another element, it can be directly on the other element, or one or more intervening elements may also be present. It will also be understood that when an element is referred to as being "under" another element, it can be directly under, or one or more intervening elements may also be present. It will also be understood that when an element is referred to as being "between" two elements, it can be the only element between the two elements, or one or more intervening elements may also be present. Like reference numerals refer to like elements throughout.

FIG. 1 is a view illustrating an organic light emitting display according to an embodiment.

Referring to FIG. 1, the organic light emitting display according to the present embodiment includes pixels 142 positioned at the intersections of scan lines S1 to Sn and data lines D1 to Dm, a pixel unit 140 including the pixels 142 arranged in a matrix, a scan driver 110 for driving the scan lines S1 to Sn and an emission control line E, a control driver 120 for driving control lines CL1 and CL2, a data driver 130 for driving the data lines D1 to Dm, and a timing controller 150 for controlling the scan driver 110, the control driver 120, and the data driver 130.

Figure 3:
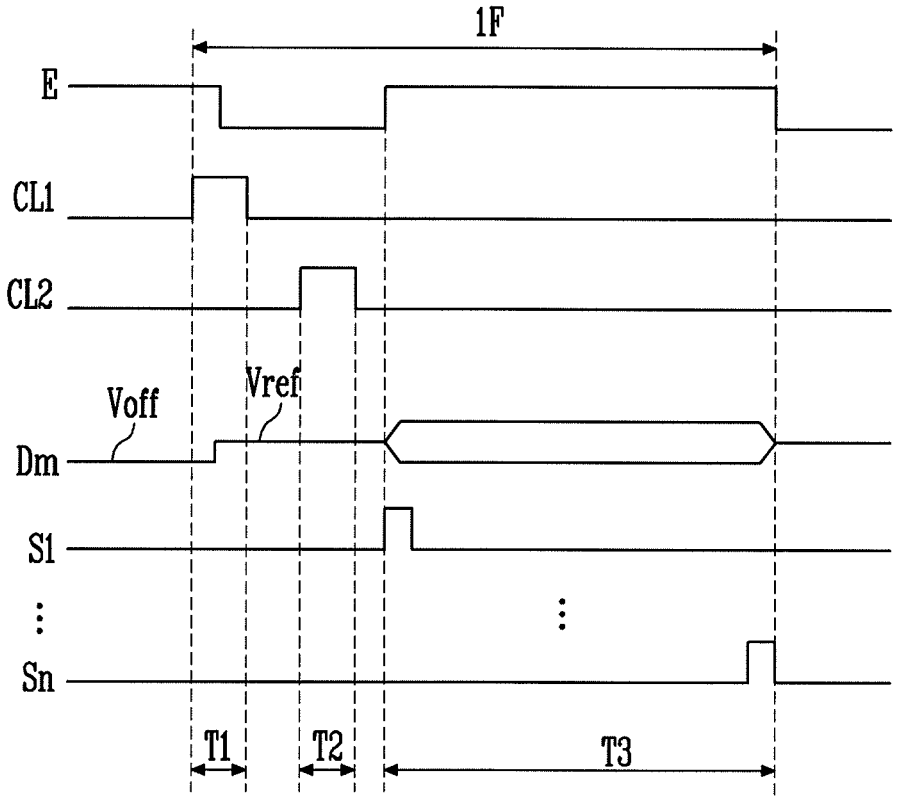
FIG. 3 is a waveform diagram illustrating an embodiment of a method of driving the pixel illustrated in FIG. 2.

The scan driver 110 supplies scan signals to the scan lines S1 to Sn. For example, the scan driver 110 may sequentially supply the scan signals to the scan lines S1 to Sn in a third period T3 (a light emitting and data writing period) of one frame 1F, as illustrated in FIG. 3.

The scan driver 110 supplies an emission control signal to the emission control line E in at least a partial period of a first period T1 (an initializing period) and a second period T2 (a compensating period). The emission control line E is commonly coupled to the pixels 142 so that whether the pixels 142 emit light is controlled to correspond to the emission control signal supplied to the emission control line E. For example, the pixels 142 may be set in a non-emission state in the first period T1 and the second period T2 where the emission control signal is supplied, and realize brightness components of predetermined gray scales to correspond to the data signals.

In an implementation, the scan signals may be set to have a voltage (for example, a high voltage) at which the transistors included in the pixels 142 may be turned on and the emission control signal may be set to have a voltage (for example, a low voltage) at which the transistors included in the pixels 142 may be turned off.

The control driver 120 drives the first control line CL1 and the second control line CL2 commonly coupled to the pixels 142. For example, the control driver 120 may supply a first control signal to the first control line CL1 in the first period T1 and supply a second control signal to the second control line CL2 in the second period T2.

The data driver 130 supplies the data signals to the data lines D1 to Dm in synchronization with the scan signals supplied to the scan lines S1 to Sn in the third period T3. The data driver 130 supplies a reference power supply Vref in at least a partial period of the first period T1 and the second period T2, and supplies an off power supply Voff in the remaining first period T1 that excludes the partial period. The reference power supply Vref is set to have a specific voltage value in the range of the voltages of the data signals, and the off power supply is set to have a voltage value capable of turning off the driving transistors included in the pixels 142.

The timing controller 150 controls the scan driver 110, the control driver 120, and the data driver 130 to correspond to synchronizing signals supplied from the outside.

The pixel unit 140 includes the pixels 142 at the intersections of the scan lines S1 to Sn and the data lines D1 to Dm. The pixels 142 realize gray scales while generating light components of predetermined brightness components to correspond to the data signals in the third period T3. For this purpose, the pixels 142 control the amount of current (which flows from the first power supply ELVDD to the second power supply ELVSS via OLEDs) to correspond to the data signals.

In FIG. 1, for convenience sake, the emission control line E is coupled to the scan driver 110 and the control lines CL1 and CL2 are coupled to the control driver 120. However, embodiments are not limited thereto. The emission control line E and the control lines CL1 and CL2 may be coupled to the above-described various drivers for supplying waveforms. For example, the emission control line E and the control lines CL1 and CL2 may be commonly coupled to the scan driver 110.

Figure 2:
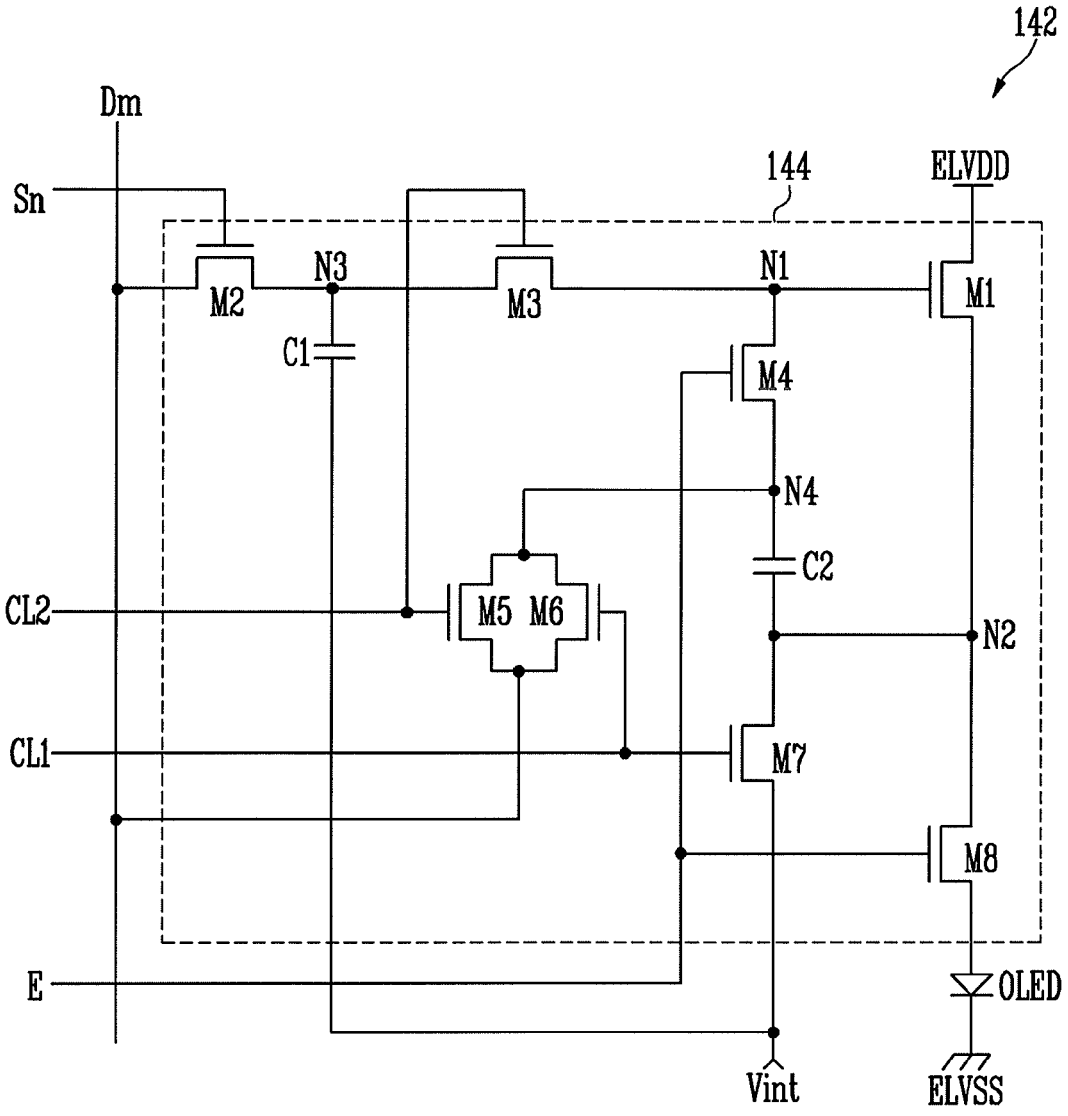
FIG. 2 is a view illustrating a first embodiment of the pixel illustrated in FIG. 1.

FIG. 2 is a view illustrating a first embodiment of the pixel illustrated in FIG. 1. In FIG. 2, for convenience sake, the pixel coupled to the mth data line Dm and the nth scan line Sn will be illustrated.

Referring to FIG. 2, according to the present embodiment, a pixel 142 includes an OLED and a pixel circuit 144 for controlling the amount of current supplied to the OLED.

The anode electrode of the OLED is coupled to the pixel circuit 144 and the cathode electrode of the OLED is coupled to the second power supply ELVSS. The OLED generates light of predetermined brightness to correspond to the amount of current supplied from the pixel circuit 144. For this purpose, the second power supply ELVSS is set to have a voltage lower than that of the first power supply ELVDD.

The pixel circuit 144 controls the amount of current supplied to the OLED to correspond to a data signal. For this purpose, the pixel circuit 144 includes first to eighth transistors M1 to M8, a first capacitor C1, and a second capacitor C2.

The first transistor M1 may be a driving transistor. The first electrode of the first transistor M1 is coupled to the first power supply ELVDD and the second electrode of the first transistor M1 is coupled to a second node N2. The gate electrode of the first transistor M1 is coupled to a first node N1. The first transistor M1 controls the amount of current supplied to the OLED to correspond to the voltage applied to the first node N1. The first electrode may be set as one of a source electrode and a drain electrode, and the second electrode may be set as a different electrode from the first electrode. For example, when the first electrode is set as the drain electrode, the second electrode is set as the source electrode.

The first electrode of the second transistor is coupled to the data line Dm and the second electrode of the second transistor M2 is coupled to a third node N3. The gate electrode of the second transistor M2 is coupled to the scan line Sn. The second transistor M2 supplies the data signal from the data line Dm to the third node N3 when the scan signal is supplied to the scan line Sn.

The first electrode of the third transistor M3 is coupled to the third node N3 and the second electrode of the third transistor M3 is coupled to the first node N1. The gate electrode of the third transistor M3 is coupled to the second control line CL2. The third transistor M3 is turned on when the second control signal is supplied to the second control line CL2 to electrically couple the third node N3 and the first node N1 to each other.

The first electrode of the fourth transistor M4 is coupled to the first node N1 and the second electrode of the fourth transistor M4 is coupled to a fourth node N4. The gate electrode of the fourth transistor M4 is coupled to the emission control line E. The fourth transistor M4 is turned off when the emission control signal is supplied to the emission control line E and is turned on in the other cases, i.e., is turned on otherwise. When the fourth transistor M4 is turned on, the first node N1 and the fourth node N4 are electrically coupled to each other.

The first electrode of the fifth transistor M5 is coupled to the data line Dm and the second electrode of the fifth transistor M5 is coupled to the fourth node N4. The gate electrode of the fifth transistor M5 is coupled to the second control line CL2. The fifth transistor M5 is turned on when the second control signal is supplied to the second control line CL2 to electrically couple the data line Dm and the fourth node N4 to each other.

The first electrode of the sixth transistor M6 is coupled to the data line Dm and the second electrode of the sixth transistor M6 is coupled to the fourth node N4. In the present embodiment, the sixth transistor M6 is coupled to the fifth transistor M5 in parallel. The sixth transistor M6 is turned on when the first control signal is supplied to the first control line CL1 to electrically couple the data line Dm and the fourth node N4 to each other.

The first electrode of the seventh transistor M7 is coupled to the second node N2 and the second electrode of the seventh transistor M7 is coupled to an initializing power supply Vint. The gate electrode of the seventh transistor M7 is coupled to the first control line CL1. The seventh transistor M7 is turned on when the first control signal is supplied to the first control line CL1 to supply the voltage of the initializing power supply Vint to the second node N2. In an implementation, the initializing power supply Vint is set to have a voltage lower than that of the data signal.

The first electrode of the eighth transistor M8 is coupled to the second node N2 and the second electrode of the eighth transistor M8 is coupled to the anode electrode of the OLED. The gate electrode of the eighth transistor M8 is coupled to the emission control line E. The eighth transistor M8 is turned off when the emission control signal is supplied to the emission control line E and is turned on in the other cases. When the eighth transistor M8 is turned on, the second node N2 and the anode electrode of the OLED are electrically coupled to each other.

The first capacitor C1 is coupled between the third node N3 and a fixed voltage supply (for example, the initializing power supply Vint). The first capacitor C1 charges the voltage corresponding to the data signal in a period where the second transistor M2 is turned on.

The second capacitor C2 is coupled between the second node N2 and the fourth node N4. The second capacitor C2 charges the voltage corresponding to the data signal and the threshold voltage of the first transistor M1. The second capacitor C2 is not charged together with the first capacitor C1 by a charge sharing method. That is, in a period where the voltage of the data signal is supplied from the first capacitor C1 to the first node N1, the second capacitor C2 is electrically blocked from the first node N1.

As described above, when the second capacitor C2 is not charged together with the first capacitor C1 by the charge sharing method, the first capacitor C1 may be set to have capacity similar to or the same as that of the second capacitor C2. When the second capacitor C2 is charged by the charge sharing method, the first capacitor C1 is set to have capacity higher (for example, no less than 5 times higher) than that of the second capacitor C2 so that the area of a layout increases.

According to the present embodiment, the transistors M1 to M8 included in the pixel circuit 144 are formed as NMOS transistors. The NMOS transistors may be manufactured at lower prices than PMOS transistors.

FIG. 3 is a waveform diagram illustrating an embodiment of a method of driving the pixel illustrated in FIG. 2.

Referring to FIG. 3, one frame period 1F according to the present embodiment includes a first period T1, a second period T2, and a third period T3. In the first period T1 as the initializing period, the first node N1 and the second node N2 are initialized to a predetermined voltage. In the second period T2 as the compensating period, the voltage corresponding to the data signal and the threshold voltage of the first transistor M1 is charged in the second capacitor C2. In the third period T3 as the light emitting and data writing period, the voltage corresponding to the data signal is charged in the first capacitor C1 and the OLED emits light with predetermined brightness.

First, in the first period T1, the first control signal is supplied to the first control line CL1. When the first control signal is supplied to the first control line CL1, the sixth transistor M6 and the seventh transistor M7 are turned on. When the sixth transistor M6 is turned on, the off power supply Voff from the data line Dm is supplied to the first node N1 via the fourth node N4. When the off power supply Voff is supplied to the first node N1, the first transistor M1 is set to be in a turned off state. When the seventh transistor M7 is turned on, the voltage of the initializing power supply Vint is supplied to the second node N2. Then, the second node N2 is initialized to the voltage of the initializing power supply Vint.

Then, in the latter half of the first period T1, the emission control signal is supplied to the emission control line E. When the emission control signal is supplied to the emission control line E, the fourth transistor M4 and the eighth transistor M8 are turned off. When the fourth transistor M4 is turned off, electric coupling between the first node N1 and the fourth node N4 is blocked. When the eighth transistor M8 is turned off, the second node N2 and the OLED are electrically blocked from each other. Then, the OLED maintains a non-emission state regardless of the voltage of the second node N2.

In the second period T2, the second control signal is supplied to the second control line CL2. When the second control signal is supplied to the second control line CL2, the third transistor M3 and the fifth transistor M5 are turned on. When the fifth transistor M5 is turned on, the voltage of the reference power supply Vref from the data line Dm is supplied to the fourth node N4.

When the third transistor M3 is turned on, the voltage of the data signal stored in the first capacitor C1 is supplied to the first node N1. At this time, since the fourth transistor M4 is set to be in a turn off state, the second capacitor C2 is not electrically coupled to the first node N1, that is, the first capacitor C1. On the other hand, when the voltage of the data signal is supplied to the first node N1, the voltage of the second node N2 is increased from the voltage obtained by subtracting the threshold voltage of the first transistor M1 from the voltage of the data signal. Then, the second capacitor C2 charges the voltage corresponding to a difference between the voltage of the fourth node N4 and the voltage of the second node N2, that is, the threshold voltage of the first transistor M1 and the voltage corresponding to the data signal.

According to the present embodiment, the voltage of the reference power supply Vref is set as a specific voltage in the range of the voltages of the data signals. Therefore, when the voltage of the data signal is controlled to be higher or lower than the reference voltage Vref, a predetermined gray scale may be realized.

In the third period T3, supply of the emission control signal to the emission control line E is stopped. When the supply of the emission control signal to the emission control line E is stopped, the fourth transistor M4 and the eighth transistor M8 are turned on. When the fourth transistor M4 is turned on, the first node N1 and the fourth node N4 are electrically coupled to each other. In this case, the voltage charged in the second capacitor C2, that is, the voltage corresponding to the data signal and the threshold voltage of the first transistor M1 is applied between the gate electrode of the first transistor M1 and the second electrode of the first transistor M1.

When the eighth transistor M8 is turned on, the second node N2 and the OLED are electrically coupled to each other. Then, the current supplied from the first transistor M1 is supplied to the second power supply ELVSS via the OLED to correspond to the voltage charged in the second capacitor C2. At this time, the OLED generates light with predetermined brightness to correspond to the current supplied thereto.

In the third period T3, the scan signals are sequentially supplied to the scan lines S1 to Sn so that the second transistor M2 is turned on in units of horizontal lines. Then, the data signal supplied from the data line Dm is stored in the first capacitor C1.

According to the present embodiment, the above-described processes are repeated to realize a predetermined gray scale. As described above, according to the present embodiment, in the period where the second capacitor C2 is charged, the second capacitor C2 is not electrically coupled to the first capacitor C1 so that the capacity of the first capacitor C1 may be minimized. Furthermore, according to the present embodiment, the period in which the second control signal is supplied to the second control line CL2 is controlled so that the threshold voltage compensating period may be sufficiently secured and that display quality may be improved. Furthermore, since the first power supply ELVDD and the second power supply ELVSS maintain a constant voltage in the frame period in the pixel 142 according to the embodiment, power consumption and electromagnetic interference (EMI) may be reduced.

Figure 4:
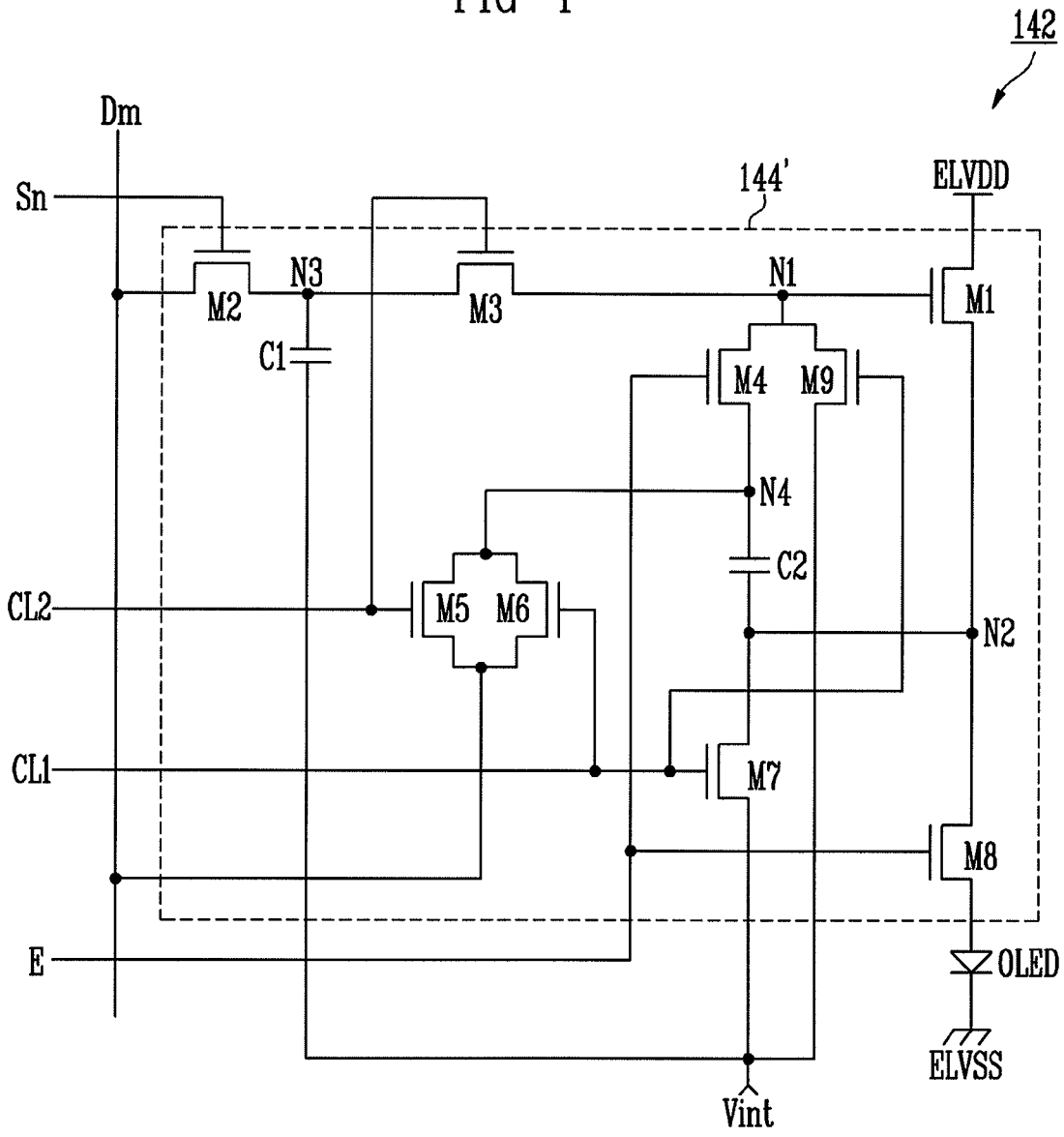
FIG. 4 is a view illustrating a second embodiment of the pixel illustrated in FIG. 1.
Figure 5:
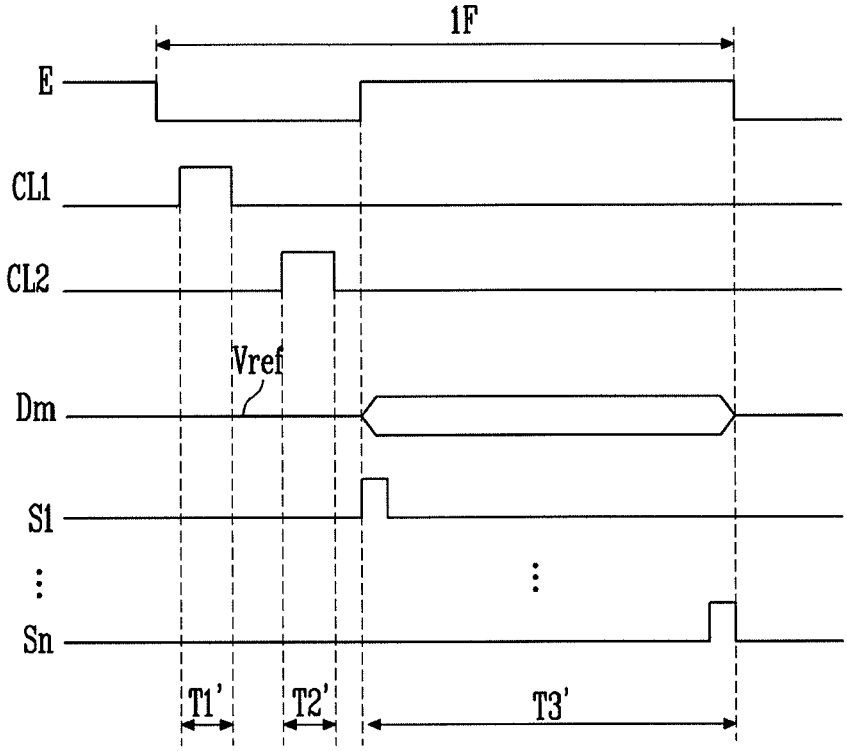
FIG. 5 is a waveform diagram illustrating an embodiment of a method of driving the pixel illustrated in FIG. 4.

FIG. 4 is a view illustrating a second embodiment of the pixel illustrated in FIG. 1. In describing FIG. 4, like reference numerals refer to like elements and detailed description of the elements will be omitted. FIG. 5 is a waveform diagram illustrating an embodiment of a method of driving the pixel illustrated in FIG. 4.

Referring to FIG. 4, a pixel 142 according to the second embodiment includes an OLED and a pixel circuit 144'. Referring to FIG. 5, one frame period according to the embodiment is divided into a first period T1', a second period T2', and a third period T3'.

The pixel circuit 144' further includes a ninth transistor M9 coupled between the first node N1 and the initializing power supply Vint. The ninth transistor M9 is turned on when the first control signal is supplied to the first control line CL1, and thus supply the voltage of the initializing power supply Vint to the first node N1.

As described above, when the initializing power supply Vint is supplied to the first node N1 using the ninth transistor M9, a bias voltage is applied to the first transistor M1 in a uniform period. When the bias voltage is applied to the first transistor M1, the threshold voltage characteristic of the first transistor M1 is initialized so that an image with uniform brightness may be displayed.

Additionally, when the initializing power supply Vint is supplied to the first node N1 using the ninth transistor M9, as illustrated in FIG. 5, the reference voltage Vref is supplied to the data line Dm in the remaining period excluding the third period T3'. Thus, an additional off power supply Voff is not supplied using the data line Dm so that reliability of driving may be improved.

In the first period T1' and the second period T2', the emission control signal is supplied to the emission control line E.

When the emission control signal is supplied to the emission control line E, the fourth transistor M4 and the eighth transistor M8 are turned off. When the fourth transistor M4 is turned off, electric coupling between the first node N1 and the fourth node N4 is blocked. When the eighth transistor M8 is turned off, the second node N2 and the OLED are electrically blocked from each other. Then, the OLED maintains a non-emission state regardless of the voltage of the second node N2.

In the first period T1', the first control signal is supplied to the first control line CL1. When the first control signal is supplied to the first control line CL1, the sixth transistor M6, the seventh transistor M7, and the ninth transistor M9 are turned on. When the sixth transistor M6 is turned on, the reference power supply Vref from the data line Dm is supplied to the fourth node n4. When the seventh transistor M7 is turned on, the voltage of the initializing power supply Vint is supplied to the second node N2. When the ninth transistor M9 is turned on, the voltage of the initializing power supply Vint is supplied to the first node N1.

In the second period T2', the second control signal is supplied to the second control line CL2. When the second control signal is supplied to the second control line CL2, the third transistor M3 and the fifth transistor M5 are turned on. When the fifth transistor M5 is turned on, the voltage of the reference power supply Vref from the data line Dm is supplied to the fourth node N4.

When the third transistor M3 is turned on, the voltage of the data signal stored in the first capacitor C1 is supplied to the first node N1. When the voltage of the data signal is supplied to the first node N1, the voltage of the second node N2 is increased to the voltage obtained by subtracting the threshold voltage of the first transistor M1 from the voltage of the data signal. Then, the second capacitor C2 charges the voltage corresponding to a difference between the voltage of the fourth node N4 and the voltage of the second node N2, that is, the voltage corresponding to the threshold voltage of the first transistor M1 and the data signal.

In the third period T3', supply of the emission control signal to the emission control line E is stopped. When the supply of the emission control signal to the emission control line E is stopped, the fourth transistor M4 and the eighth transistor M8 are turned on. When the fourth transistor M4 is turned on, the first node N1 and the fourth node N4 are electrically coupled to each other. In this case, the voltage charged in the second capacitor C2, that is, the voltage corresponding to the data signal and the threshold voltage of the first transistor M1, is applied between the gate electrode of the first transistor M1 and the second electrode of the first transistor M1.

When the eighth transistor M8 is turned on, the second node N2 and the OLED are electrically coupled to each other. Then, the current supplied from the first transistor M1 is supplied to the second power supply ELVSS via the OLED to correspond to the voltage charged in the second capacitor C2. At this time, the OLED generates light with predetermined brightness to correspond to the current supplied thereto. In the third period T3', the scan signals are sequentially supplied to the scan lines S1 to Sn so that the second transistor M2 is turned on in units of horizontal lines. Then, the data signal supplied from the data line Dm is stored in the first capacitor C1.

The pixel according to the second embodiment realizes a predetermined gray scale while repeating the above-described processes.

Figure 6:
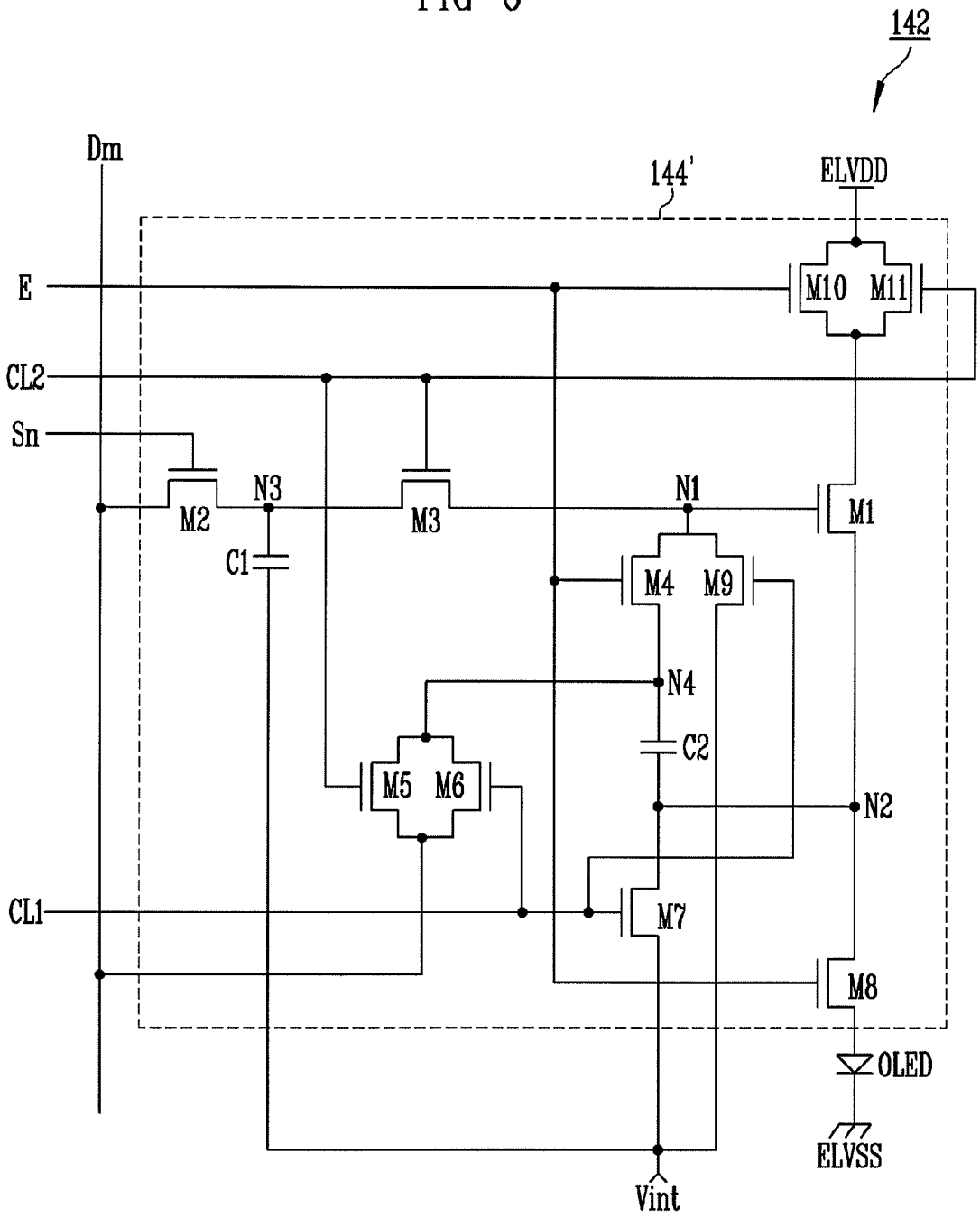
FIG. 6 is a view illustrating a third embodiment of the pixel illustrated in FIG. 1.

FIG. 6 is a view illustrating a third embodiment of the pixel illustrated in FIG. 1. In describing FIG. 6, like reference numerals refer to like elements and detailed description of the elements will be omitted.

Referring to FIG. 6, a pixel 142 according to the third embodiment includes an OLED and a pixel circuit 144".

The pixel circuit 144" further includes a tenth transistor M10 and an eleventh transistor M11 coupled between the first power supply ELVDD and the first electrode of the first transistor M1, with the eleventh transistor M11 coupled in parallel with the tenth transistor M10.

The tenth transistor M10 is turned off when the emission control signal is applied to the emission control line E and is turned on in the other periods. As illustrated in FIG. 5, the tenth transistor M10 is turned on in the third period T3', and is turned off in the first period T1' and the second period T2'.

The eleventh transistor M11 is turned on when the second control signal is supplied to the second control line CL2. As illustrated in FIG. 5, the eleventh transistor M11 is turned on in the second period T2' to electrically couple the first transistor M1 and the first power supply ELVDD to each other. Here, in the second period T2, the voltage corresponding to the data signal and the threshold voltage of the first transistor M1 is applied to the second node n2.

The pixel illustrated in FIG. 6 is driven by the waveform diagram of FIG. 5. In the pixel illustrated in FIG. 6, the remaining structure (excluding the structure in which the first transistor M1 and the first power supply ELVDD are selectively coupled to each other by the tenth transistor M10 and the eleventh transistor M11) and the operation processes are the same as those of the pixel illustrated in FIG. 4. Therefore, description of the structure and operation processes of the pixel illustrated in FIG. 6 will not be repeated.

By way of summation and review, an organic light emitting display includes a plurality of pixels arranged at intersections of a plurality of data lines, scan lines, and power supply lines in a matrix. Each of the pixels may include an organic light emitting diode (OLED), at least two transistors including a driving transistor, and at least one capacitor.

The organic light emitting display has advantage in that an amount of used power is small. However, an amount of current that flows to the OLEDs changes in accordance with deviation in the threshold voltages of the driving transistors included in the pixels so that non-uniformity in display may result. Thus, the characteristics of the driving transistors may change in accordance with the manufacturing process variables of the driving transistors included in the pixels, and it may be difficult to manufacture the organic light emitting display so that all of the transistors of the organic light emitting display have the same characteristic. Thus, deviation in the threshold voltages of the driving transistors may occur.

In view of the above, consideration may be given to adding compensating circuits, each formed of a plurality of transistors and a capacitor, to the respective pixels. The compensating circuits included in each of the pixels may charge voltage corresponding to the threshold voltages of the driving transistors in one horizontal period so that the deviation in the driving transistors may be compensated for.

Also, in order to remove a motion blur phenomenon, the organic light emitting display may be driven with a higher driving frequency of, e.g., 120 Hz. However, when the organic light emitting display is driven at high speed, e.g., 120 Hz, a period of charging the threshold voltages of the driving transistors may be reduced, making it difficult to compensate for the threshold voltages of the driving transistors.

Also, a structure in which driving power supplies (a first power supply ELVDD and a second power supply ELVSS)

are changed to correspond to high speed driving may be considered, but when the driving power supplies are changed high power consumption and large electromagnetic interference (EMI) may be generated. In addition, when the driving power supplies are changed, reverse voltages may be applied to the OLEDs so that reliability is deteriorated.

As described above, embodiments may provide a pixel capable of improving display quality and an organic light emitting display using the same. According to embodiments, the pixels may commonly compensate for the threshold voltages so that the threshold voltage compensating period is sufficiently secured and display quality may be improved, while the driving power supplies may not be changed and maintain a constant voltage so that power consumption and electromagnetic interference (EMI) may be minimized. Furthermore, according to embodiments, in the period where the first capacitor (which primarily charges the data signal) supplies the charged voltage to the gate electrode of the driving transistor, the first capacitor is electrically blocked from the second capacitor coupled to the gate electrode of the driving transistor. Thus, the second capacitor is not charged together with the first capacitor by a charge sharing method, and the capacity of the first capacitor may thus be minimized.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A pixel, comprising:

an organic light emitting diode (OLED);

a first transistor having a gate electrode coupled to a first node, a first electrode coupled to a first power supply, and a second electrode coupled to the OLED;

a first capacitor for storing a data signal;

a second capacitor coupled between the first node and the second electrode of the first transistor, the second capacitor to charge a voltage corresponding to the data signal and a threshold voltage of the first transistor;

a second transistor coupled between a data line and a first terminal of the first capacitor, the second transistor being turned on when a scan signal is supplied to a scan line;

a third transistor coupled between the first terminal of the first capacitor and the first node, the third transistor being turned on when a second control signal is supplied;

a fourth transistor coupled between the first node and a first terminal of the second capacitor, the fourth transistor having a turn on period that does not overlap a turn on period of the third transistor, the fourth transistor being turned off when an emission control signal is supplied;

a fifth transistor coupled between the first terminal of the second capacitor and the data line, the fifth transistor being simultaneously turned on and off with the third transistor;

a sixth transistor coupled between the first terminal of the second capacitor and the data line, the sixth transistor having a turn on period that does not overlap a turn on period of the fifth transistor;

a seventh transistor coupled between a second terminal of the second capacitor and an initializing power supply, the seventh transistor being simultaneously turned on and off with the sixth transistor; and an eighth transistor coupled between the second electrode of the first transistor and the OLED, the eighth transistor being simultaneously turned on and off with the fourth transistor, wherein, in a period where the data signal stored in the first capacitor is supplied to the first node, the second capacitor is electrically blocked from the first node.

2. The pixel as claimed in claim 1, wherein a second terminal of the first capacitor is coupled to a fixed voltage supply.

3. The pixel as claimed in claim 2, wherein the second terminal of the first capacitor is coupled to the initializing power supply having a smaller voltage value than the data signal.

4. The pixel as claimed in claim 1, wherein the sixth transistor has a turn on period that partially overlaps the turn on period of the fourth transistor.

5. The pixel as claimed in claim 1, wherein the sixth transistor has a turn on period that does not overlap the turn on period of the fourth transistor.

6. The pixel as claimed in claim 5, further comprising a ninth transistor coupled between the first node and the initializing power supply, the ninth transistor being simultaneously turned on and off with the sixth transistor.

7. The pixel as claimed in claim 5, further comprising a tenth transistor and an eleventh transistor each coupled between the first power supply and the first transistor, the eleventh transistor being coupled in parallel with the tenth transistor, wherein:

the tenth transistor is simultaneously turned on and off with the fourth transistor, and the eleventh transistor is simultaneously turned on and off with the third transistor.

8. The pixel as claimed in claim 1, wherein an amount of current flowing to the OLED is controlled according to a level of the voltage corresponding to the data signal and the threshold voltage of the first transistor.

9. The pixel as claimed in claim 1, wherein in the period where the data signal stored in the first capacitor is supplied to the first node, the second capacitor charges the voltage corresponding to the data signal and the threshold voltage of the first transistor.

10. An organic light emitting display, comprising:

a control driver for supplying a first control signal to a first control line in a first period of one frame and for supplying a second control signal to a second control line in a second period of the one frame;

a scan driver for sequentially supplying scan signals to scan lines in a third period of the one frame and for supplying an emission control signal to an emission control line in at least a partial period of the first period and the second period;

a data driver for supplying a voltage of a reference power supply to data lines in the at least partial period of the first period and the second period, and for supplying a data signal in the third period; and pixels at intersections of the scan lines and the data lines and including a first transistor, a first capacitor, and a second capacitor, wherein each of the pixels stores a voltage corresponding to the data signal in the first capacitor in the third period, and charges a voltage corresponding to the data signal and a threshold voltage of the first transistor in the second capacitor, electrically blocked from the first capacitor, using the data signal stored in the first capacitor in the second period wherein each of the pixels comprises:

an organic light emitting diode (OLED);

the first transistor having a gate electrode coupled to a first node, a first electrode coupled to a first power supply, and a second electrode coupled to the OLED;

the second capacitor coupled between the first node and the second electrode of the first transistor;

a second transistor coupled between a data line and a first terminal of the first capacitor, the second transistor being turned on when the scan signal is supplied;

a third transistor coupled between the first terminal of the first capacitor and the first node, the third transistor being turned on when the second control signal is supplied; and a fourth transistor coupled between the first node and a first terminal of the second capacitor, the fourth transistor being turned off when the emission control signal is supplied and turned on otherwise.

11. The organic light emitting display as claimed in claim 10, wherein the reference power supply is a specific voltage in a range of voltages of the data signal.

12. The organic light emitting display as claimed in claim 10, wherein a second terminal of the first capacitor is coupled to an initializing power supply set to have a smaller voltage value than the data signal.

13. The organic light emitting display as claimed in claim 10, further comprising:

a fifth transistor coupled between the first terminal of the second capacitor and the data line, the fifth transistor being turned on when the second control signal is supplied;

a sixth transistor coupled between the first terminal of the second capacitor and the data line, the sixth transistor being turned on when the first control signal is supplied;

a seventh transistor coupled between a second terminal of the second capacitor and an initializing power supply, the seventh transistor being turned on when the first control signal is supplied; and an eighth transistor coupled between the second electrode of the first transistor and the OLED, the eighth transistor being turned off when the emission control signal is supplied and turned on otherwise.

14. The organic light emitting display as claimed in claim 13, wherein the initializing power supply is set to have a smaller voltage value than the data signal.

15. The organic light emitting display as claimed in claim 13, wherein the scan driver supplies the emission control signal after the first control signal is supplied in the first period.

16. The organic light emitting display as claimed in claim 15, wherein the data driver supplies a voltage of an off power supply at which the first transistor is turned off in at least a partial period of the first period.

17. The organic light emitting display as claimed in claim 13, wherein the scan driver supplies the emission control signal so that the emission control signal overlaps the first control signal and the second control signal in the first period and the second period.

18. The organic light emitting display as claimed in claim 17, wherein the data driver supplies the voltage of the reference power supply to the data lines in the first period and the second period.

19. The organic light emitting display as claimed in claim 17, further comprising a ninth transistor coupled between the first node and the initializing power supply, the ninth transistor being turned on when the first control signal is supplied.

20. The organic light emitting display as claimed in claim 17, further comprising:

a tenth transistor coupled between the first power supply and the first transistor, the tenth transistor being turned off when the emission control signal is supplied and turned on otherwise; and an eleventh transistor coupled between the first power supply and the first transistor, in parallel with the tenth transistor, the eleventh transistor being turned on when the second control signal is supplied.

* * * * *